United States Patent [19]

Yunt

[11] 4,103,950

[45] Aug. 1, 1978

[54] LATCH SHIELD

[76] Inventor: Daniel C. Yunt, 928 Susan Lee La., Modesto, Calif. 95350

[21] Appl. No.: 736,719

[22] Filed: Oct. 28, 1976

[51] Int. Cl.[2] ..... E05C 3/06

[52] U.S. Cl. ..... 292/346; 292/DIG. 13; 292/225; 292/340

[58] Field of Search ..... 292/340, 346, 341.14, 292/225, DIG. 13

[56] References Cited

U.S. PATENT DOCUMENTS

| | | | |
|---|---|---|---|
| 1,582,265 | 4/1926 | Griffin | 292/225 |
| 2,237,996 | 4/1941 | Mitchell | 292/346 X |
| 2,495,930 | 1/1950 | Guinard | 292/238 |
| 3,990,182 | 11/1976 | Linder | 70/18 X |

FOREIGN PATENT DOCUMENTS

| | | | |
|---|---|---|---|
| 313,072 | 12/1933 | Italy | 292/225 |

*Primary Examiner*—Richard E. Moore

*Attorney, Agent, or Firm*—Clarence A. O'Brien; Harvey B. Jacobson

[57] ABSTRACT

A latch shield for covering a latch assembly and preventing opening of the latch assembly from outside of a closure associated with the latch assembly. The shield has a hollow interior arranged for receiving the latch asembly and is attached to a stationary frame of the associated closure for spanning the gap between the stationary frame and a movable element of the closure when the movable element is in a position blocking access through the closure in order to prevent a tool inserted through the gap from releasing the latch assembly and permit opening of the closure.

4 Claims, 4 Drawing Figures

LATCH SHIELD

BACKGROUND OF THE INVENTION

1. Field of the Invention

This invention relates generally to a latch guard, and particularly to a guard for a latch assembly such as employed with garage doors and similar closures in order to prevent unauthorized releasing of the latch assembly from without the structure associated with the closure.

2. Description of the Prior Art

A problem encountered with the latch assemblies as conventionally employed on garage doors and similar closures is that a simple tool that can be made of almost any scrap metal can be used to release the latch from outside the structure associated with the closure.

U.S. Pat. Nos. 2,237,996, issued Apr. 8, 1941 to E. V. Mitchell, and 2,683,054, issued July 6, 1954 to O. Earman, show the use of latch covers disposed about a latch assembly in such a manner as to prevent unauthorized release of the latch assembly from without a closed closure by means of a tool inserted from the outside of the closure through the gap which normally is found between the stationary frame and movable element of a closure.

Further, U.S. Pat. Nos. 2,798,753, issued July 9, 1957 to E. E. Wade; 3,414,306, issued Dec. 3, 1968 to A. A. Bernstein; and 3,718,014, issued Feb. 27, 1973 to F. M. Delgadillo, disclose covers for various locking devices which hinder access to the locking device in order to tamper with same.

SUMMARY OF THE INVENTION

It is an object of the present invention to provide a latch shield for a latch assembly as commonly employed with garage doors and similar closures.

It is another object of the present invention to provide a latch shield which will prevent tampering with a latch assembly even where a tool can be inserted between the frame and door of a closure associated with the latch assembly.

These and other objects are achieved according to the present invention by providing a latch shield including a cover member having a hollow interior arranged for receiving the associated latch assembly, and provided with a mounting arrangement for permitting attachment of the cover member to a stationary part of the associated closure.

According to a preferred embodiment of the invention, the cover member is substantially wedge-shaped and is arranged covering a keeper of the latch assembly which is mounted on a door part of the associated closure for preventing a tool from being inserted between the frame part and the door part of the closure and releasing the keeper.

The mounting arrangement advantageously includes a flange arranged fastened to the frame part of the closure so as to permit the cover member to bridge the gap between the closure's frame part and door part.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
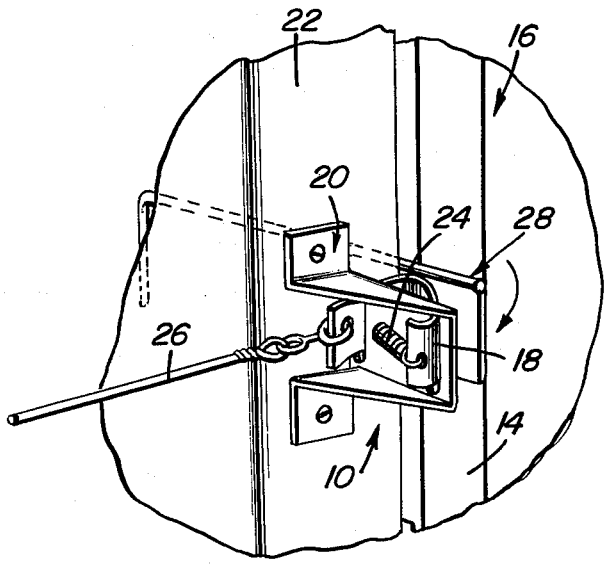
FIG. 1 is a fragmentary, perspective view showing a latch assembly with which the latch shield of the invention is specifically intended to be used.

Referring now more particularly to FIG. 1 of the drawing, a latch assembly 10 is illustrated which includes a door stop 12 (FIG. 3) mounted on a frame 14 of a conventional closure 16 such as a garage door arrangement, and the like. Assembly 10 also includes a tongue 18 movably arranged in slots provided in a bracket 20 affixed to door 22 of closure 16 and biased into engagement with door stop 12 as by the conventional coiled tension spring 24. Tongue 18 is moved away from engagement with door stop 12, against the bias of spring 24, by a cable 26 which can be manipulated from outside of closure 16, the inner portion being shown in FIG. 1, as by a suitable lockable handle arrangement (not shown) disposed on the outer surface of closure 16. As can be seen from FIG. 1, a very simple tool 28 which can be made of almost any scrap metal can be fitted in the gap between frame 14 and door 22 in order to press against tongue 18 and force tongue 18 away from engagement with door stop 12 in order to release latch assembly 10 and permit opening of door 22.

Figure 2:
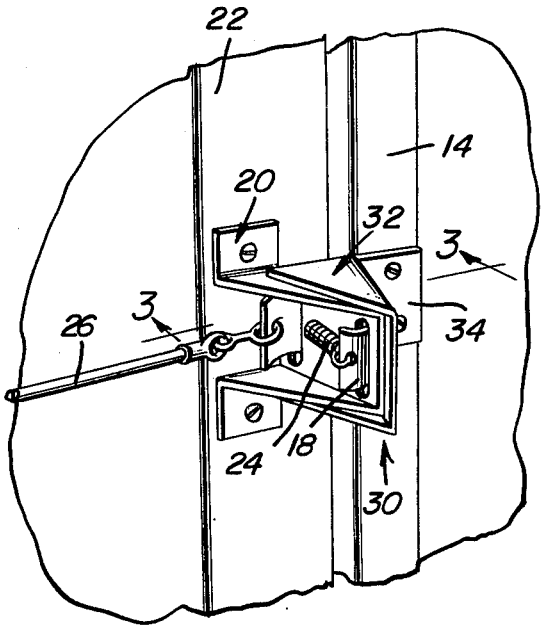
FIG. 2 is a fragmentary, perspective view similar to FIG. 1, but showing the latch shield according to the present invention in position guarding the latch assembly.
Figure 3:
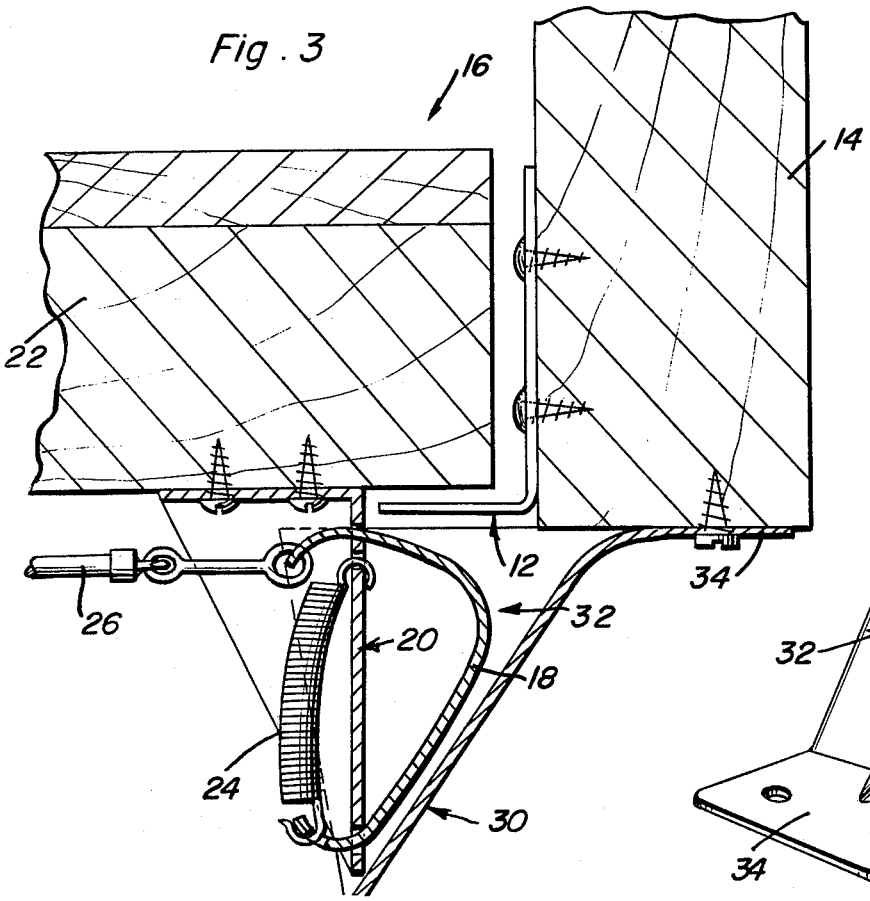
FIG. 3 is an enlarged, fragmentary, sectional view taken generally on the line 3—3 of FIG. 2.
Figure 4:
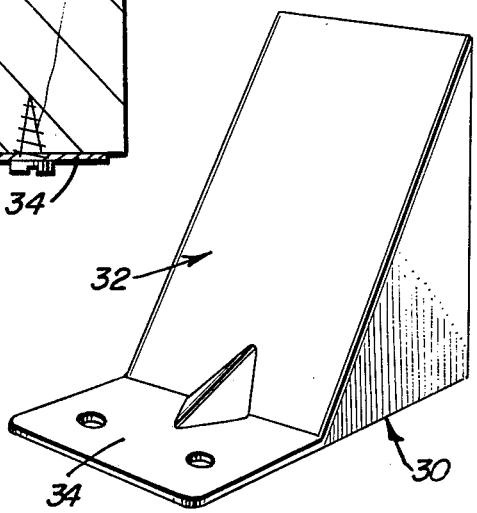
FIG. 4 is a perspective view showing a latch shield according to the present invention.

Referring now more particularly to FIGS. 2 through 4 of the drawings, it can be seen that a latch shield 30 according to the invention can be arranged over latch assembly 10 in order to prohibit use of a tool such as tool 28 shown in FIG. 1 in order to release latch assembly 10 and open closure 16. This latch shield 30 includes a cover member 32 of substantially wedge-shape and having a hollow interior arranged for receiving tongue 18, bracket 20, and spring 24 of latch assembly 10. Cover member 32 is also provided with a mounting device in the form of flange 34 for permitting attachment of cover member 32 to frame 14 in such a manner that cover member 32 bridges the gap between frame 14 and door 22 and prevents insertion of a tool 28 into the gap in such a manner as to permit engagement of tongue 18 by tool 28 in order to release latch assembly 10. It will be appreciated that door 22 must be arranged so as to open away from both the door stop 12 and cover member 32 when moving from the illustrated closed position of closure 16 to an open position permitting passage through frame 14.

As will be appreciated from the above description and from the drawings, a latch shield 30 according to the invention essentially covers tongue 18 of latch assembly 10 and prevents the flag-portion of a tool 28 to come into engagement with tongue 18 in such a manner as to depress tongue 18 upon rotation of tool 28 as shown by the arrow in FIG. 1 and release tongue 18 from engagement with door stop 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a latch assembly including a door stop, a tongue, a spring biasing the tongue toward engagement with the door stop, and a manipulating means for pulling the tongue away from engagement with the door stop against the bias of the spring, a latch shield for covering the latch assembly and preventing opening of the latch assembly from outside of a closure associated with the latch assembly, the latch shield comprising a cover member separate from the latch assembly and having a hollow interior arranged for protectively receiving the latch assembly with engaging the latch assembly, and provided with a mounting means for permitting attachment of the member to a stationary frame part associated with the closure.

2. A structure as defined in claim 1, wherein the cover member is substantially wedge-shaped and is normally arranged covering, in spaced relation, a keeper of the latch assembly mounted on a movable element of the latch assembly for preventing a tool from being inserted between the stationary frame part and the closure itself and releasing the keeper.

3. A structure as defined in claim 2, wherein the mounting means includes a flange arranged fastened to the stationary frame part.

4. A structure as defined in claim 1, wherein the mounting means includes a flange arranged fastened to the stationary frame part.

* * * * *